US011667118B2

(12) United States Patent
Sugiura et al.

(10) Patent No.: US 11,667,118 B2
(45) Date of Patent: Jun. 6, 2023

(54) LIQUID DISCHARGING HEAD

(71) Applicant: Brother Kogyo Kabushiki Kaisha, Nagoya (JP)

(72) Inventors: Keita Sugiura, Toyokawa (JP); Taisuke Mizuno, Yokkaichi (JP); Shotaro Kanzaki, Handa (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 33 days.

(21) Appl. No.: 17/328,602

(22) Filed: May 24, 2021

(65) Prior Publication Data

US 2021/0402766 A1 Dec. 30, 2021

(30) Foreign Application Priority Data

Jun. 29, 2020 (JP) ..... JP2020-111208

(51) Int. Cl.
*B41J 2/14* (2006.01)

(52) U.S. Cl.
CPC .... *B41J 2/1433* (2013.01); *B41J 2002/14419* (2013.01)

(58) Field of Classification Search
CPC ..... B41J 2/1433; B41J 2002/14419
See application file for complete search history.

(56) References Cited

U.S. PATENT DOCUMENTS

2008/0036824 A1* 2/2008 Ishikawa ..... B41J 2/161 347/71
2011/0085012 A1* 4/2011 Nishikawa ..... B41J 2/14233 347/92

FOREIGN PATENT DOCUMENTS

JP 2019-202549 A 11/2019

* cited by examiner

*Primary Examiner* — Jason S Uhlenhake
(74) *Attorney, Agent, or Firm* — Banner & Witcoff, Ltd.

(57) ABSTRACT

There is provided a liquid discharging head including: a plurality of supply manifolds configured to receive a liquid to be discharged from a plurality of nozzles and provided side by side with each other; a supply integration channel arranged on a first side in a longitudinal direction of the supply manifolds; a first connecting channel connecting the supply integration channel and a first supply manifold of the supply manifolds; and a second connecting channel connecting the supply integration channel and a second supply manifold, of the supply manifolds, being adjacent to the first supply manifold in a short direction of the first supply manifold. An outlet of the first connecting channel is arranged on the first side in the longitudinal direction of the supply manifolds; and an outlet of the second connecting channel is arranged on a second side in the longitudinal direction of the supply manifolds.

9 Claims, 7 Drawing Sheets

LIQUID DISCHARGING HEAD

CROSS REFERENCE TO RELATED APPLICATION

The present application claims priority from Japanese Patent Application No. 2020-111208, filed on Jun. 29, 2020, the disclosure of which is incorporated herein by reference in its entirety.

BACKGROUND

The present disclosure relates to a liquid discharging head (liquid discharge head).

Japanese Patent Application Laid-open No. 2019-202549 discloses a liquid discharging head provided with a first integration channel, a first common channel, individual channels, a second common channel, and a second integration channel. The first integration channel is arranged on a side of one end in the longitudinal direction of the first common channel, and the second integration channel is arranged on a side of the other end in the longitudinal direction of the first common channel. In such a configuration, liquid such as an ink, etc., which is heated to have a predetermined temperature, is allowed to flow in an order of: the first integration channel, the first common channel, the individual channels, the second common channel and the second integration channel.

SUMMARY

According to an aspect of the present disclosure, there is provided a liquid discharging head including:

a plurality of supply manifolds which is configured to receive a liquid to be discharged from a plurality of nozzles, and which is provided side by side with each other;

a supply integration channel arranged on a first side in a longitudinal direction of the plurality of supply manifolds;

a first connecting channel connecting the supply integration channel and a first supply manifold of the plurality of supply manifolds; and a second connecting channel connecting the supply integration channel and a second supply manifold of the plurality of supply manifolds, the second supply manifold being different from the first supply manifold and being adjacent to the first supply manifold in a short direction of the first supply manifold, wherein an outlet of the first connecting channel is arranged on the first side in the longitudinal direction of the plurality of supply manifolds; and an outlet of the second connecting channel is arranged on a second side, opposite to the first side, in the longitudinal direction of the plurality of supply manifolds.

DESCRIPTION

Figure 1:
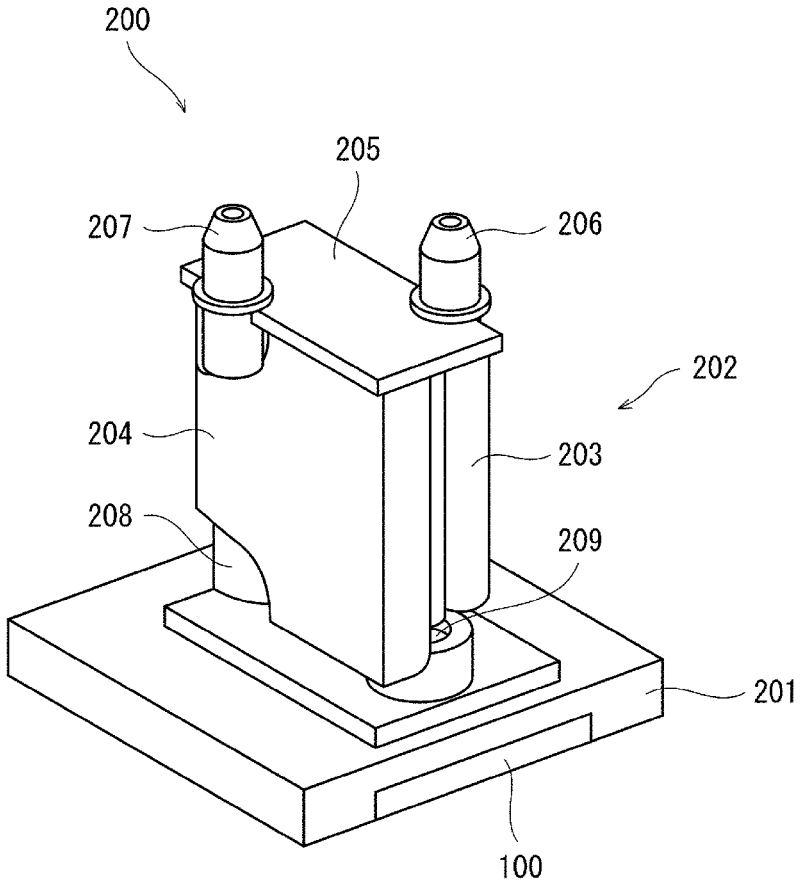
FIG. 1 is a perspective view depicting the outer appearance of a liquid discharging apparatus provided with a liquid discharging head according to a first embodiment of the present disclosure.

In the conventional liquid discharging apparatus, the liquid is subjected to heat radiation as the liquid flows toward the downstream side, and is cooled. Accordingly, the temperature of the liquid on the side of the one end in the longitudinal direction of a supply manifold becomes to be high, and the temperature of the liquid on the side of the other end in the longitudinal direction of the supply manifold becomes to be lower than the temperature of the liquid on the side of the one end in the longitudinal direction of the supply manifold. As a result, there is such a problem that any variation in the discharging property (discharging performance) is generated between a nozzle arranged on the side of the one end in the longitudinal direction of the supply manifold and a nozzle arranged on the side of the other end in the longitudinal direction of the supply manifold.

In view of the above-described situation, an object of the present disclosure is to provide a liquid discharging head capable of suppressing any variation in the discharging property between the nozzle arranged on the side of the one end in the longitudinal direction of the supply manifold and the nozzle arranged on the side of the other end in the longitudinal direction of the supply manifold.

According to the present disclosure, the outlet of the first integration channel is arranged on the side of the one end in the longitudinal direction of the supply manifolds; and the outlet of the second integration channel is arranged on the side of the other end in the longitudinal direction of the supply manifolds. With this, the temperature gradient in the liquid inside the supply manifold connected to the first connecting channel and the temperature gradient in the liquid inside the supply manifold connected to the second connecting channel becomes to be symmetric to each other, thereby cancelling any difference in the temperature between the liquids in two supply manifolds which are adjacent to each other in the short direction, owing to the transfer of the heat between the two adjacent supply manifolds, thus suppressing any deviation or polarization in the heat in the liquid between the two supply manifolds which are adjacent to each other. Due to such a configuration, it is possible to suppress any variation in the discharging property between the nozzle arranged on the side of the one end in the longitudinal direction of the supply manifolds and the nozzle arranged on the side of the other end in the longitudinal direction of the supply manifolds.

According to the present disclosure, it is possible to provide a liquid discharging head capable of suppressing any variation in the discharging property between the nozzle arranged on the side of the one end in the longitudinal direction of the supply manifold and the nozzle arranged on the side of the other end in the longitudinal direction of the supply manifold.

In the following, a liquid discharging head according to an embodiment of the present invention will be explained, with reference to the drawings. The liquid discharging head to be explained below is merely an embodiment of the present invention. Therefore, the present invention is not limited to or restricted by the following embodiment; it is allowable to make any addition, deletion and change to the present disclosure, within the range not departing from the gist and spirit of the present invention.

First Embodiment

A liquid discharging apparatus 200 provided with a liquid discharging head 100 according to the present embodiment is configured, for example, to discharge (eject) a liquid such as an ink, etc.

As depicted in FIG. 1, the liquid discharging apparatus 200 of the present embodiment is provided with a head installing part 201 and a housing 202 provide on the head installing part 201. The liquid discharging head 100, which is to be described later on, is installed in the head installing part 201.

The housing 202 has sub housings 203 and 204. Upper parts of the sub housings 203 and 204 are connected to a supporting structure 205, thereby allowing the sub housings 203 and 204 to be fixed, while facing each other. Each of the sub housings 203 and 204 is formed, for example, to have a thin box shape.

The sub housing 204 has a liquid inlet port 207 at an upper part thereof, and a liquid outlet port 208 at a lower part thereof. The liquid inflowed into the sub housing 204 from the liquid inlet port 207 is filtered in the inside of the sub housing 204, and is then fed out from the liquid outlet port. 208 to a channel inside the head installing part 201 (a channel connecting or linking to the liquid discharging head 100).

On the other hand, the sub housing 203 has a liquid outlet port 206 at an upper part thereof, and a liquid inlet port 209 at a lower part thereof. The liquid fed out from the channel inside the head installing part 201 enters from the liquid inlet port 209 into the inside of the sub housing 203. Then, the liquid is filtered in the inside of the sub housing 203, and is then returned to the liquid inlet port 207, from the liquid outlet port 206, by a pressure of a non-illustrated pump provided between the liquid outlet port 206 and the liquid inlet port 207, thereby allowing the liquid to be circulated.

Figure 2:
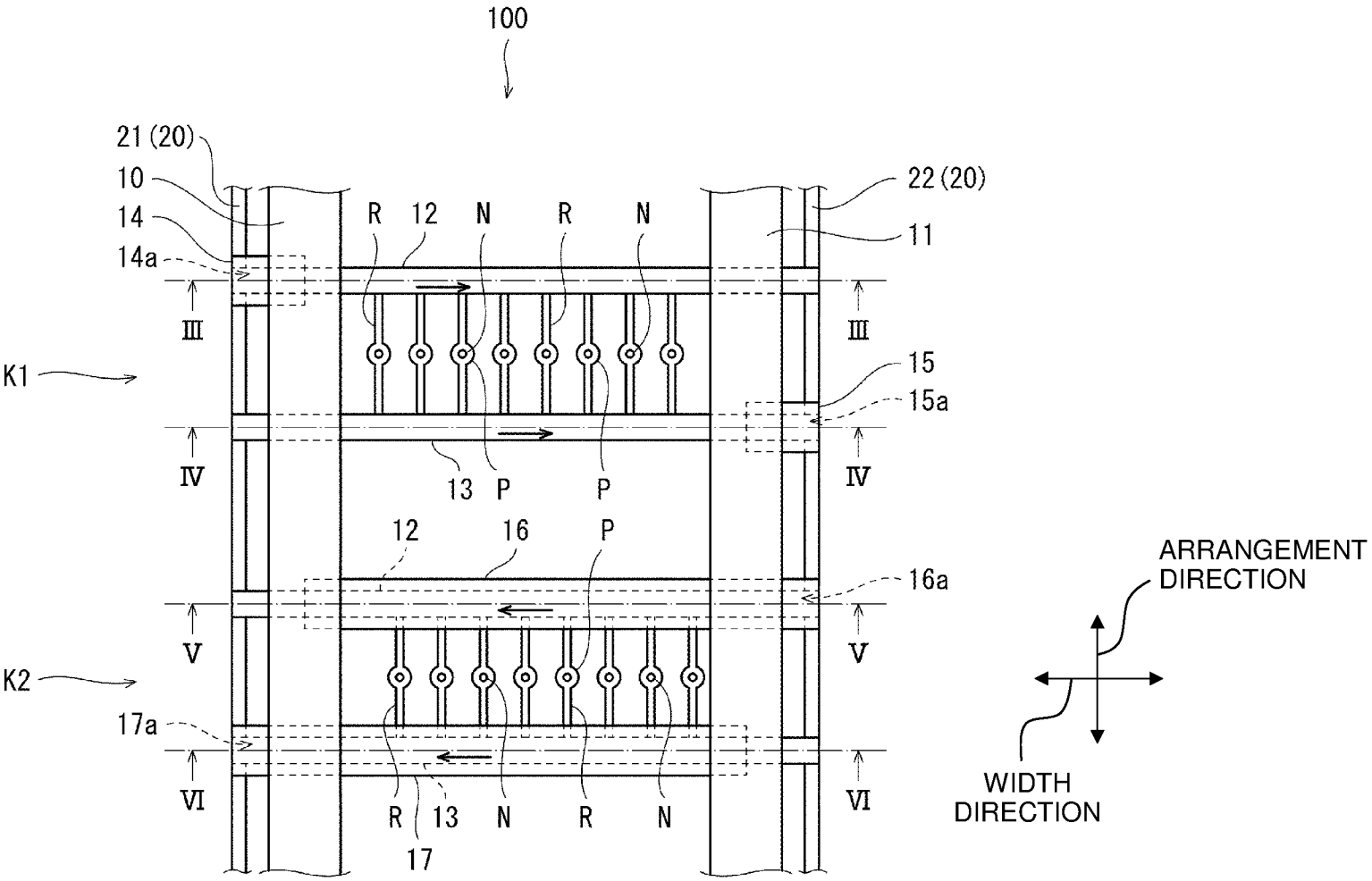
FIG. 2 is a plan view depicting the liquid discharging head according to the first embodiment.

In the following, the liquid discharging head 100 of the present embodiment will be specifically explained. FIG. 2 is a plan view depicting the liquid discharging head 100. Note that FIG. 2 depicts only the channel for the liquid, and illustration of parts or portions forming the channel are omitted in FIG. 2.

As depicted in FIG. 2, the liquid discharging head 100 of the present embodiment is provided with a supply integration channel 10, a return integration channel 11, a plurality of supply manifolds 12, a plurality of return manifolds 13, a plurality of first interposer channels 14 (corresponding to a "first connecting channel"), a plurality of returning short interposer channels 15, a plurality of second interposer channels 16 (corresponding to a "second connecting channel"), and a plurality of returning long interposer channels 17.

In a state that the supply integration channel 10 and the return integration channel 11 are apart or separated from each other in a width direction (a longitudinal direction of each of the plurality of supply manifolds 12; in the present specification, the width direction is also referred to as a "left-right direction", in this case, a side of the supply integration channel 10 is referred to as the left side, and a side of the return integration channel 11 is referred to as the right side), each of the supply integration channel 10 and the return integration channel 11 extends in an arrangement direction which is orthogonal to the width direction (in the present specification, the arrangement direction is also referred to as a "front-rear direction"). The supply integration channel 10 is arranged on the side of the left end (corresponding to the "side of one end" or "first side", the same shall apply hereafter) in the width direction. The return integration channel 11 is arranged on the side of the right end (corresponding to the "side of the other end" or "second side", the same shall apply hereafter) in the width direction. The supply integration channel 10 and the return integration channel 11 allow, for example, a liquid such as an ink, etc., to flow therethrough.

The plurality of supply manifolds 12 and the plurality of return manifolds 13 are provided alternately in the arrangement direction. In the example depicted in FIG. 2, from the upper side in the paper surface of FIG. 2, one supply manifold 12, one return manifolds 13, another supply manifold 12 and another return manifold 13 are arranged in this order. In the following, for the sake of convenience of the explanation, a combination of the one supply manifold 12 and the one return manifold 13 are referred to as a supply-return combination K1, and a combination of the another supply manifold 12 and the another return manifold 13 are referred to as a supply-return combination K2. A plurality of pieces of the supply-return combination K1 and a plurality of pieces of the supply-return combination K2 as described above are provided alternately in the arrangement direction. A spacing distance between the supply-return combination K1 and the supply-return combination K2 is, for example, constant. That is, a plurality of pieces of the supply-return combination K1 and a plurality of pieces of the supply-return combination K2 are arranged in the arrangement direction, for example, at equal intervals. Further, a spacing distance between the supply manifold 12 and the return manifold 13 is, for example, constant among a plurality of pieces of the supply-return combination K1 and a plurality of pieces of the supply-return combination K2.

Each of the plurality of supply manifolds 12 and each of the plurality of return manifolds 13 extend in the width direction. In the supply-return combination K1, an upstream end (left end) of the supply manifold 12 is arranged on the outer side (left side) with respect to the supply integration channel 10 in the width direction, and a downstream end (right end) of the supply manifold 12 is arranged on the outer side (right side) with respect to the return integration channel 11 in the width direction. Similarly, an upstream end (left end) of the return manifold 13 is arranged on the outer side (left side) with respect to the supply integration channel 10, and a downstream end (right end) of the return manifold 13 is arranged on the outer side (right side) with respect to the return integration channel 11 in the width direction. On the other hand, in the supply-return combination K2, an upstream end (right end) of the supply manifold 12 is arranged on the outer side (right side) with respect to the return integration channel 11 in the width direction, and a downstream end (left end) of the supply manifold 12 is arranged on the outer side (left side) with respect to the supply integration channel 10 in the width direction. Similarly, an upstream end (right end) of the return manifold 13 is arranged on the outer side (right side) with respect to the return integration channel 11, and a downstream end (left end) of the return manifold 13 is arranged on the outer side (left side) with respect to the supply integration channel 10 in the width direction.

The first interposer channel 14 is a component for the supply-return combination K1. The first interposer channel 14 connects or links the supply manifold 12 in the supply-return combination K1 and the supply integration channel 10. An outlet port 14*a* of the first interposer channel 14 (a downstream end of the first interposer channel 14) is arranged on the side of the left end with respect to a central part in the longitudinal direction of the supply manifold 12; in FIG. 2, the outlet port 14*a* is connected to the left end of the supply manifold 12. A length (length in the width direction) of the first interposer channel 14 is made to be shorter than the length of the second interposer channel 16, as will be described later on. In such a configuration, the liquid from the supply integration channel 10 is allowed to flow into the supply manifold 12 via the first interposer channel 14.

The returning short interposer channel 15 is a component for the supply-return combination K1. The returning short interposer channel 15 connects or links the one return manifold 13 in the supply-return combination K1 and the return integration channel 11. An inlet port 15*a* of the returning short interposer channel 15 (an upstream end of the returning short interposer channel 15) is arranged on the right side with respect to a central part in the longitudinal direction of the return manifold 13. The liquid from the return manifold 13 is allowed to flow into the return integration channel 11 via the returning short interposer channel 15.

A plurality of individual channels R connecting the supply manifold 12 and the return manifold 13 are provided on the supply-return combination K1. Each of the plurality of individual channels R extends in the arrangement direction between the supply manifold 12 and the return manifold 13. The plurality of individual channels R are arranged side by side in the width direction at a substantially equal spacing distance therebetween. A pressure chamber P and a nozzle N which has, for example, a circular shape in a plan view are connected to an intermediate part of each of the above-described plurality of individual channels R. A plurality of pieces of the nozzle N are arranged side by side in the width direction. Each of the plurality of nozzles N discharges the liquid.

On the other hand, the second interposer channel 16 is a component for the supply-return combination K2. The second interposer channel 16 connects or links the supply manifold 12 in the supply-return combination K2 and the supply integration channel 10. An outlet port 16*a* of the second interposer channel 16 (a downstream end of the second interposer channel 16) is arranged on the right side with respect to a central part in the longitudinal direction of the supply manifold 12; in FIG. 2, the outlet port 16*a* is connected to the right end of the supply manifold 12. Namely, in a reverse manner to that the outlet port 14*a* of the first interposer channel 14 is arranged on the side of the left end of the supply manifold 12 in the supply return combination K1 as described above, the outlet port 16*a* of the second interposer channel 16 is arranged on the side of the right end of the supply manifold 12 in the supply-return combination K2. Accordingly, the second interposer channel 16 is formed to be long in the width direction. Accordingly, a length (length in the width direction) of the second interposer channel 16 is made to be longer than the length of the first interposer channel 14. In such a configuration, the liquid from the supply integration channel 10 is allowed to flow into the supply manifold 12 via the second interposer channel 16.

Channel resistance in the second interposer channel 16 is made to be substantially same as channel resistance in the first interposer channel 14. The term "channel resistance" indicates easiness of the flow of liquid in a channel, and is a value of resistance in the channel, in other words, a value obtained by integrating a value of resistance per a unit length of the channel, along a channel length of the channel. In the present embodiment, as described above, the length of the second interposer channel 16 is longer than the length of the first interposer channel 14. Namely, it is possible to make the channel resistances of the first and second interposer channels 14 and 16 to be same, by making the channel cross-sectional area of the first interposer channel 14 and the channel cross-sectional area of the second interposer channel 16 to be different from each other. Specifically, the channel cross-sectional area of the first interposer channel 14 of which length is relatively short is made to be smaller than the channel cross-sectional area of the second interposer channel 16 of which length is relatively long.

The returning long interposer channel 17 is a component for the supply-return combination K2. The returning long interposer channel 17 connects or links the return manifold 13 in the supply-return combination K2 and the return integration channel 11. An inlet port 17*a* of the returning long interposer channel 17 (an upstream end of the returning long interposer channel 17) is arranged on the side of the left end of the return manifold 13. In such a configuration, the liquid from the return manifold 13 is allowed to flow into the return integration channel 11 via the returning long interposer channel 17.

Also in the supply-return combination K2, a plurality of individual channels R connecting the supply manifold 12 and the return manifold 13 are provided, similarly to the supply-return combination K1. A nozzle N from which the liquid is discharged is connected to an intermediate part of each of the plurality of individual channels R.

The liquid discharging head 100 of the present embodiment is provided with a bypass channel 20 extending in the arrangement direction. The bypass channel 20 communicates the supply manifold 12 and the return manifold 13 which are adjacent to each other in the arrangement direction. The bypass channel 20 includes an upstream (upstream-side) bypass channel 21 and a downstream (downstream-side) bypass channel 22. The upstream bypass channel 21 communicates an upstream end of the supply manifold 12 with an upstream end of the return manifold 13 in each of the plurality of the supply-return combinations K1, and communicates a downstream end of the supply manifold 12 with a downstream end of the return manifold 13 in each of the supply-return combinations K2. Further, the downstream bypass channel 22 communicates a downstream end of the supply manifold 12 with a downstream end of the return manifold 13 in each of the supply-return combinations K1, and communicates an upstream end of the supply manifold 12 with an upstream end of the return manifold 13 in each of the supply-return combinations K2. With such a configuration, not only that the liquid is allowed to flow from a supply manifold 12 to a return manifold 13 which is adjacent thereto via the plurality of individual channels R, the liquid is allowed to flow from the supply manifold 12 to the return manifold 13 which is adjacent thereto via the upstream bypass channel 21 and the downstream bypass channel 22, as well. Accordingly, the flow rate of the liquid flowing through the supply manifold 12 can be increased. With this, it is possible to enhance the heat uniformizing effect for the liquid.

In the supply-return combination K1 as explained above, the liquid flowing through the supply integration channel 10 flows into the left end of the supply manifold 12 via the first interposer channel 14. After that, the liquid inside the supply manifold 12 flows rightward and flows into the plurality of individual channels R, and is discharged from the plurality of nozzles N. Note that the liquid which has not been discharged from the plurality of nozzles N is allowed to flow into the return integration channel 11 via the return manifold 13 and the returning short interposer channel 15.

In contrast, in the supply-return combination K2, the liquid flowing through the supply integration channel 10 flows into the right end of the supply manifold 12 via the second interposer channel 16. After that, the liquid inside the supply manifold 12 flows leftward and flows into the plurality of individual channels R, and is discharged from the plurality of nozzles N. Namely, a flowing direction (from the left side toward the right side) of the liquid in the supply manifold 12 in the supply-return combination K1 and a flowing direction (from the right side toward the left side) of the liquid in the supply manifold 12 in the supply-return combination K2 are mutually opposite (reverse) ructions. Note that the liquid which has not been discharged from the plurality of nozzles N is allowed to flow into the return integration channel 11 via the return manifold 13 and the returning long interposer channel 17.

Next, the configuration of the cross-section of the liquid discharging head 100 of the present embodiment will be explained, with reference to the drawings.

Figure 3:
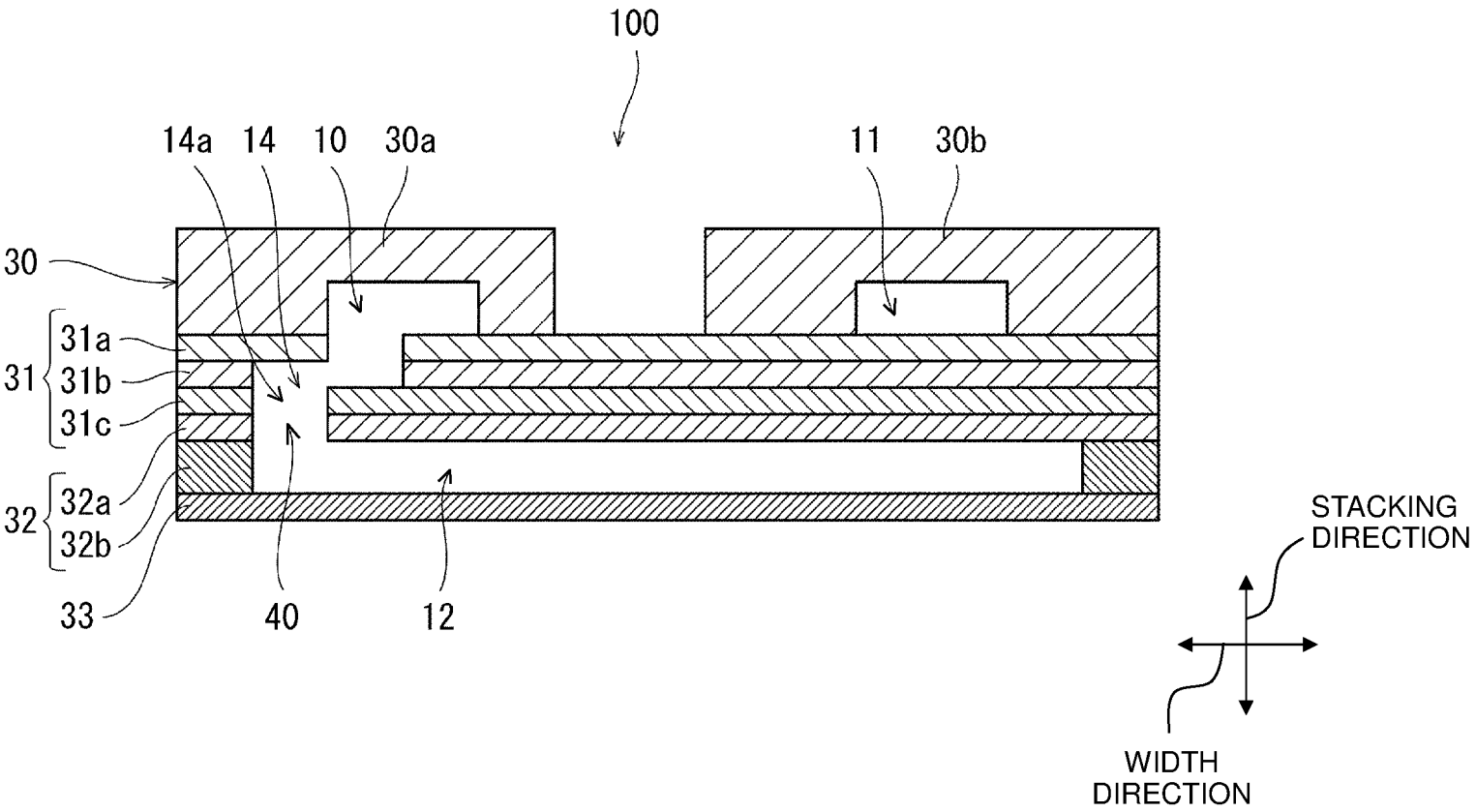
FIG. 3 is a cross-sectional view taken along a line in FIG. 2.

FIG. 3 is a cross-sectional view taken along a Ill-Ill line in FIG. 2. As depicted in FIG. 3, the liquid discharging head 100 includes a stacked body formed of a plurality of plates. Specifically, the liquid discharging head 100 includes a reservoir plate 30, an interposer plate 31, a manifold plate 32, and a nozzle plate 33. Note that the nozzle plate 33, the manifold plate 32, the interposer plate 31 and the reservoir plate 30 are stacked in this order.

The nozzles N are formed to penetrate through the nozzle plate 33 in a stacking direction (in the present specification, the stacking direction is referred to as an "up-down direction", as well). Note that although each of the nozzles N is formed by one plate which is the nozzle plate 33, each of the nozzles N may be formed by two or more plates.

The manifold plate 32 includes a first channel plate 32*a* and a second channel plate 32*b*. The supply manifold 12 is formed by penetrating through the second channel plate 32*b* in the stacking direction. The supply manifold 12 is formed (arranged) so that a center in the width direction of the second channel plate 32*b* is substantially coincide (matches) with a center in the width direction of the supply manifold 12. As described above, the supply manifold 12 extends in the width direction, and the supply manifold 12 communicates with the plurality of nozzles N via the plurality of individual channels R, respectively. Note that although the supply manifold 12 is formed by one plate which is the second channel plate 32*b*, the supply manifold 12 may be formed by two or more plates.

Further, a connecting channel 40 is formed by penetrating through the first channel plate 32*a* in the stacking direction. The connecting channel 40 connects or links the upstream end of the supply manifold 12 and the downstream end of the first interposer channel 14. The connecting channel 40 is arranged on the left side in the width direction of the supply manifold 12.

The interposer plate 31 includes a third channel plate 31*a*, a fourth channel plate 31*b* and a fifth channel plate 31*c* each of which has a through hole formed therein. The first interposer channel 14 is constructed by combining the through holes formed in the third channel plate 31*a*, the fourth channel plate 31*b* and the fifth channel plate 31*c*, respectively. Specifically, the through hole in the third channel plate 31*a* is formed at a location below the supply integration channel 10. The size of the through hole in the third channel plate 31*a* is smaller than the width of the supply integration channel 10. Further, the through hole in the fourth channel plate 31*b* is constructed of a first part formed below the through hole in the third channel plate 31*a*, and a second part which is formed on the left side of the first part. Furthermore, the through hole in the fifth channel plate 31*c* is arranged between the second part and the above-described connecting channel 40 in the stacking direction. The size of the through hole in the fifth channel plate 31*c* is same as the width of the second part. Such through holes are combined to thereby form the first interposer channel 14.

A first reservoir part 30*a* and a second reservoir part 30*b* which are apart from each other are formed in the reservoir plate 30. The supply integration channel 10 is formed in a predetermined area which is located at a lower half in the stacking direction of the first reservoir part 30*a*; and the return integration channel 11 is formed in a predetermined area which is located at a lower half in the stacking direction of the second reservoir part 30*b*.

Figure 4:
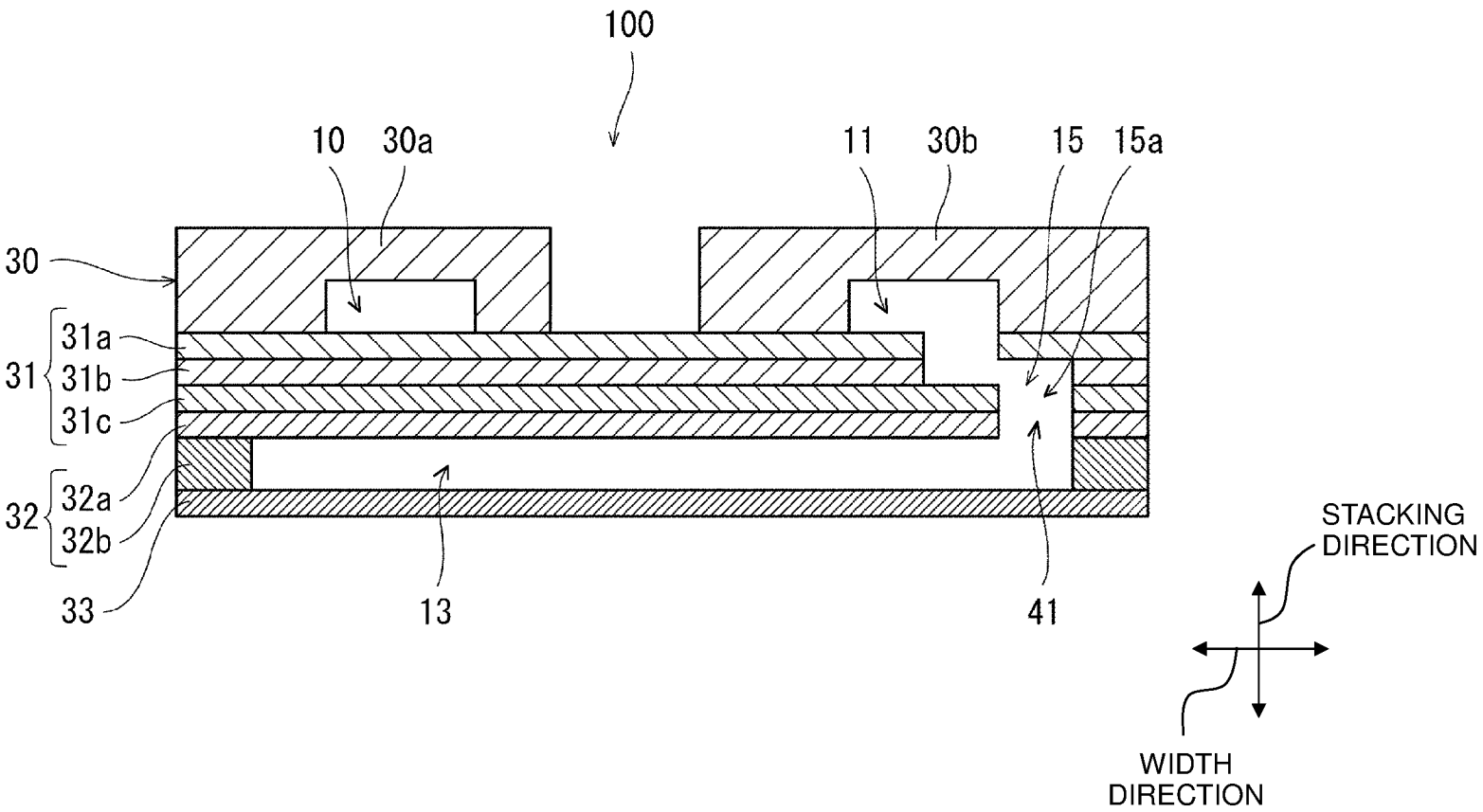
FIG. 4 is cross-sectional view taken along a IV-IV line in FIG. 2.

Next, FIG. 4 is cross-sectional view taken along a line in FIG. 2. The cross-sectional view in FIG. 4 is bilaterally symmetric with respect to the above-described cross-sectional view of FIG. 3. In the following, any explanation regarding a part overlapping with the content explained with respect to FIG. 3 will be omitted, and only a content different from that in FIG. 3 will be explained. This is applied similarly to FIGS. 5 and 6 which will be described later on.

As depicted in FIG. 4, a connecting channel 41 is formed by penetrating through the first channel plate 32*a* in the stacking direction. The connecting channel 41 connects or links the downstream end of the return manifold 13 and the upstream end of the returning short interposer channel 15. The connecting channel 41 is arranged on the right side in the width direction of the return manifold 13.

The returning short interposer channel 15 is constructed by combining through holes which are formed in the third channel plate 31*a*, the fourth channel plate 31*b* and the fifth channel plate 31*c* and which are different from the above-described through holes formed in the third channel plate 31*a*, the fourth channel plate 31*b* and the fifth channel plate 31*c*, respectively. Specifically, the through hole in the third channel plate 31*a* is formed at a location below the return integration channel 11. The size of the through hole in the third channel plate 31*a* is smaller than the width of the return integration channel 11. Further, the through hole in the fourth channel plate 31*b* is constructed of a first part formed below the through hole in the third channel plate 31*a*, and a second part which is formed on the right side of the first part. Furthermore, the through hole in the fifth channel plate 31*c* is arranged between the second part and the above-described connecting channel 41 in the stacking direction. The size of the through hole in the fifth channel plate 31*c* is same as the width of the second part. Such through holes are combined to thereby form the returning short interposer channel 15.

In the present embodiment, the cross-sectional area of the return manifold 13 is substantially same as the cross-sectional area of the supply manifold 12. For example, it is allowable that the supply manifold 12 and the return manifold 13 have sizes and shapes which are same as each other. In such a case, it is allowable that the supply manifold 12 and the return manifold 13 have mutually same sizes in the arrangement direction, the width direction, and the stacking direction, respectively.

Figure 5:
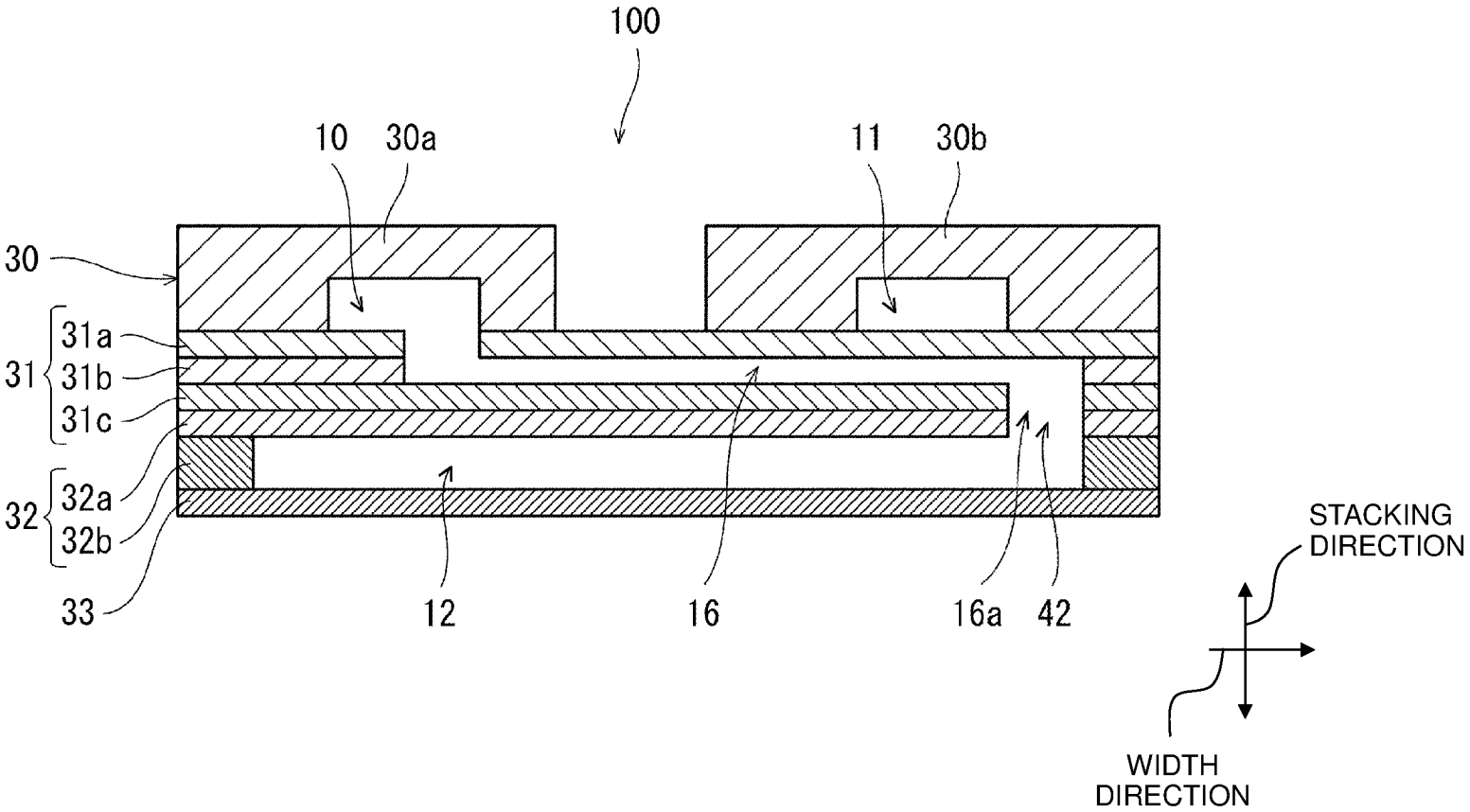
FIG. 5 is a cross-sectional view taken along a V-V line in FIG. 2.

Next, FIG. 5 is cross-sectional view taken along a V-V line in FIG. 2. As depicted in FIG. 5, a connecting channel 42 is formed by penetrating through the first channel plate 32*a* in the stacking direction. The connecting channel 42 connects or links the upstream end of the supply manifold 12 and the downstream end of the second interposer channel 16. The connecting channel 42 is arranged on the right side in the width direction of the supply manifold 12.

The second interposer channel 16 is constructed by combining through holes formed in the third channel plate 31*a*, the fourth channel plate 31*b* and the fifth channel plate 31*c*, respectively. Specifically, the through hole in the third channel plate 31*a* is formed at a location below the supply integration channel 10. The size of the through hole in the third channel plate 31*a* is smaller than the width of the supply integration channel 10. Further, the through hole in the fourth channel plate 31*b* is constructed of a first part formed below the through hole in the third channel plate 31*a*, and a second part which is formed on the right side of the first part and which extends up to a location above the connecting channel 42. Furthermore, the through hole in the fifth channel plate 31*c* is arranged between the second part and the above-described connecting channel 42 in the stacking direction. The size of the through hole in the fifth channel plate 31*c* is same as the width of the connecting channel 42. Such through holes are combined to thereby form the second interposer channel 16.

Figure 6:
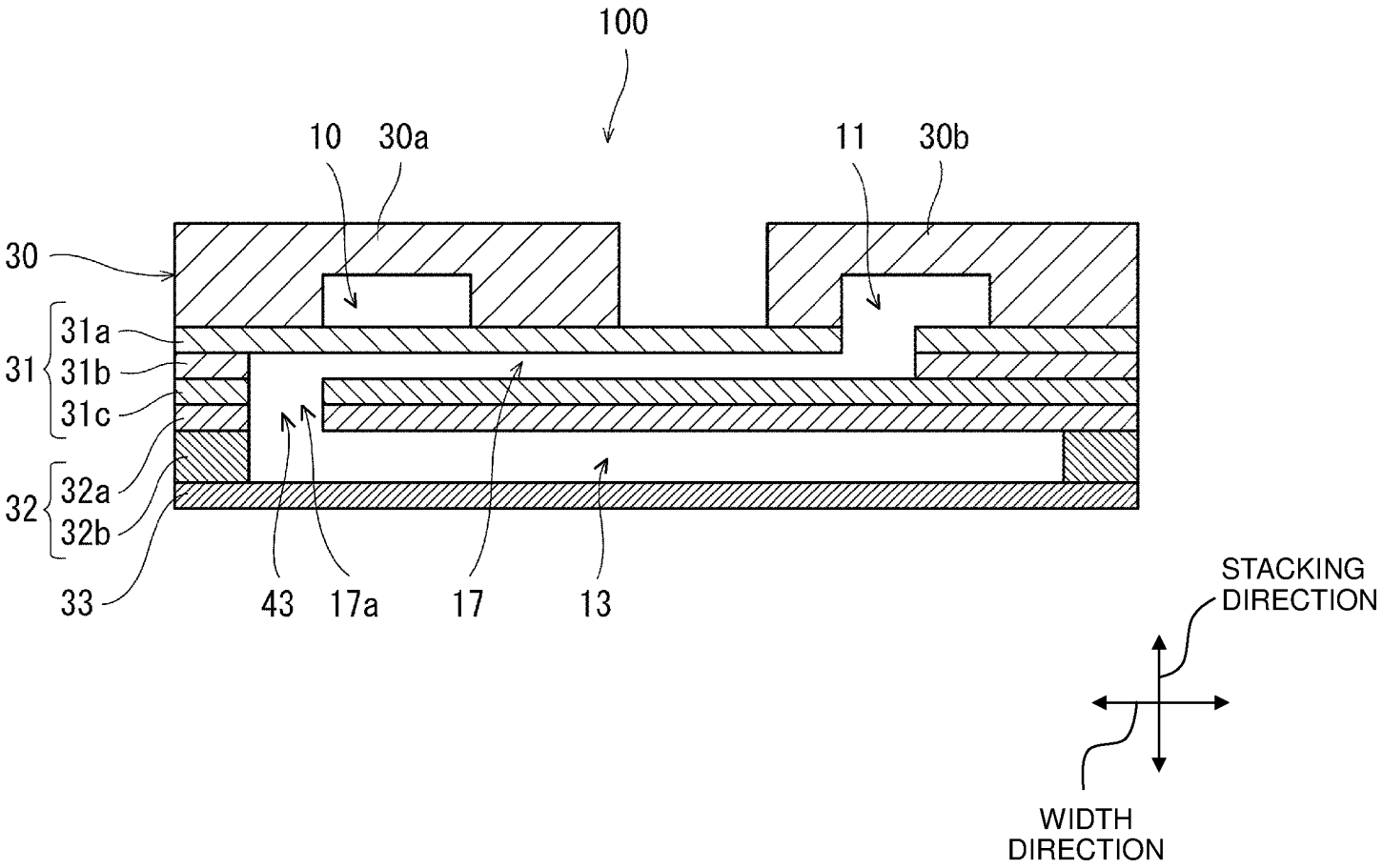
FIG. 6 is a cross-sectional view taken along a VI-VI line in FIG. 2.

Next, FIG. 6 is cross-sectional view taken along a VI-VI line in FIG. 2. The cross-sectional view in FIG. 6 is bilaterally symmetric with respect to the above-described cross-sectional view of FIG. 5.

As depicted in FIG. 6, a connecting channel 43 is formed by penetrating through the first channel plate 32*a* in the stacking direction. The connecting channel 43 connects or links the downstream end of the return manifold 13 and the upstream end of the returning long interposer channel 17. The connecting channel 43 is arranged on the left side in the width direction of the return manifold 13.

The returning long interposer channel 17 is constructed by combining through holes formed in the third channel plate 31*a*, the fourth channel plate 31*b* and the fifth channel plate 31*c*, respectively. Specifically, the through hole in the third channel plate 31*a* is formed at a location below the return integration channel 11. The size of the through hole in the third channel plate 31*a* is smaller than the width of the return integration channel 11. Further, the through hole in the fourth channel plate 31*b* is constructed of a first part formed below the through hole in the third channel plate 31*a*, and a second part which is formed on the left side of the first part and which extends up to a location above the connecting channel 43. Furthermore, the through hole in the fifth channel plate 31*c* is arranged between the second part and the above-described connecting channel 43 in the stacking direction. The size of the through hole in the fifth channel plate 31*c* is same as the width of the connecting channel 43. Such through holes are combined to thereby form the returning long interposer channel 17.

As explained above, in the liquid discharging head 100 of the present embodiment, the outlet port 14*a* of the first interposer channel 14 is arranged on the side of the one end in the width direction of the one supply manifold 12, and the outlet port 16*a* of the second interposer channel 16 is arranged on the side of the other end in the width direction of the another supply manifold 12, thereby making the temperature gradient in the liquid inside the supply manifold 12 connected to the first interposer channel 14 (the supply manifold 12 in the supply-return combination K1) and the temperature gradient in the liquid inside the manifold 12 connected to the second interposer channel 16 (the supply manifold 12 in the supply-return combination K2) becomes to be symmetric to each other. Specifically, the temperature of the liquid which is supplied to the supply manifold 12 via the outlet port 14*a* of the first interposer channel 14 in the supply-return combination K1 is high at the left end in the supply manifold 12 and becomes to be lower toward the right end in the supply manifold 12. Namely, the temperature gradient of the liquid is lowered from the left end toward the right end of the supply manifold 12 in the supply-return combination K1. On the other hand, the temperature of the liquid which is supplied to the supply manifold 12 via the outlet port 16*a* of the second interposer channel 16 in the supply-return combination K2 is high at the right end in the supply manifold 12 and becomes to be lower toward the left end in the supply manifold 12. Namely, the temperature gradient of the liquid is lowered from the right end toward the left end of the supply manifold 12 in the supply-return combination K2. Accordingly, the temperature gradient of the supply manifold 12 in the supply-return combination K1 and the temperature gradient of the supply manifold 12 in the supply-return combination K2 becomes to be symmetrical at same positions thereof in the width direction, respectively. Since this cancels any difference in the temperatures of the liquids between two supply manifolds 12, which are included in the plurality of supply manifolds 12 and which are adjacent to each other in the arrangement direction, owing to the transfer of the heat between the two adjacent supply manifolds 12, thus suppressing any deviation or polarization in the heat in the liquid between the two supply manifolds 12 which are adjacent to each other. Due to such a configuration, it is possible to suppress any variation in the discharging property between the nozzle N arranged on the side of the one end in the width direction of each of the supply manifolds 12 and the nozzle N arranged on the side of the other end in the width direction of each of the supply manifolds 12.

Further, in the present embodiment, the plurality of supply manifolds 12 and the plurality of return manifolds 13 are directly connected to one another via the bypass channel 20 which does not pass through the plurality of individual channels R. With this, the flow rate of the liquid in each of the supply manifold 12 and the return manifold 13 can be increased. By increasing the flow rate of the liquid in such a manner, the increase and decrease in the temperature of the liquid are suppressed. Thus, it is possible to made any difference between a high temperature of the liquid and a low temperature of the liquid to be small. Accordingly, the levelling in the temperature in the entire liquid is promoted, thereby making it possible to further enhance the heat uniformizing effect for the liquid.

Furthermore, in the present embodiment, since the bypass channel 20 is constructed of the upstream bypass channel 21 and the downstream bypass channel 22, the difference in the flow rate of the liquid among the respective individual channels R becomes to be small; even in a case that any bending in flying (curved discharge, curved ejection) (of the liquid) occurs, the orientation and amount of the bending becomes to be of similar extents, respectively, among all the nozzles N, thereby making it possible to minimize any effect on the precision of the landing (or the liquid).

Moreover, in the present embodiment, the flowing direction of the liquid in the supply manifold 12 in the supply-return combination K1 and the flowing direction of the liquid in the supply manifold 12 in the supply-return combination K2 are mutually opposite (reverse) directions. With this, the respective supply manifolds 12, 12 and the respective interposer channels 14 and 16 are arranged to be overlap with one another, respectively, in the up-down direction. Accordingly, it is possible to realize a small-sized liquid discharging head 100.

Further, in the present embodiment, the first interposer channel 14 is connected to the end part of the supply manifold 12 in the supply-return combination K1, and the second interposer channel 16 is connected to the end part of the supply manifold 12 in the supply-return combination K2. With this, since the heat of the liquid in each of the supply manifolds 12 is dissipated or dispersed across the length direction of each of the supply manifolds 12, thereby making it possible to maximize the heat uniformizing effect for the liquid.

Furthermore, in the present embodiment, the channel resistance of the first interposer channel 14 and the channel resistance of the second interposer channel 16 are substantially same, thereby making it possible to make the flow rate of the liquid in the supply manifold 12 in the supply-return combination K1 and the flow rate of the liquid in the supply manifold 12 in the supply-return combination K2 to be of a same extent.

Moreover, in the present embodiment, the cross-sectional area of the first interposer channel 14 is different from the cross-sectional area of the second interposer channel 16. In such a manner, in order to make the channel resistance of the first interposer channel 14 and the channel resistance of the second interposer channel 16 to be same, it is enough to make the cross-sectional areas of the respective channels to be different. With this, the processing for making the respective channel resistances to be same can be performed very easily.

Further, in the present embodiment, since the plurality of nozzles N are arranged side by side in the longitudinal direction of the supply manifold 12, it is possible to contribute to the miniaturization of the liquid discharging apparatus 100.

Second Embodiment

Next, an explanation will be given about a liquid discharging head 100A according to a second embodiment of the present disclosure. Note that in the second embodiment, a same reference numeral is affixed to a component which is same as that in the first embodiment, and any explanation therefor will be omitted, unless specifically described.

The configuration of the liquid discharging head 100A of the second embodiment is different from the configuration of the liquid discharging head 100 of the first embodiment in view of the shape of the first interposer channel and the shape of the returning short interposer channel.

Figure 7:
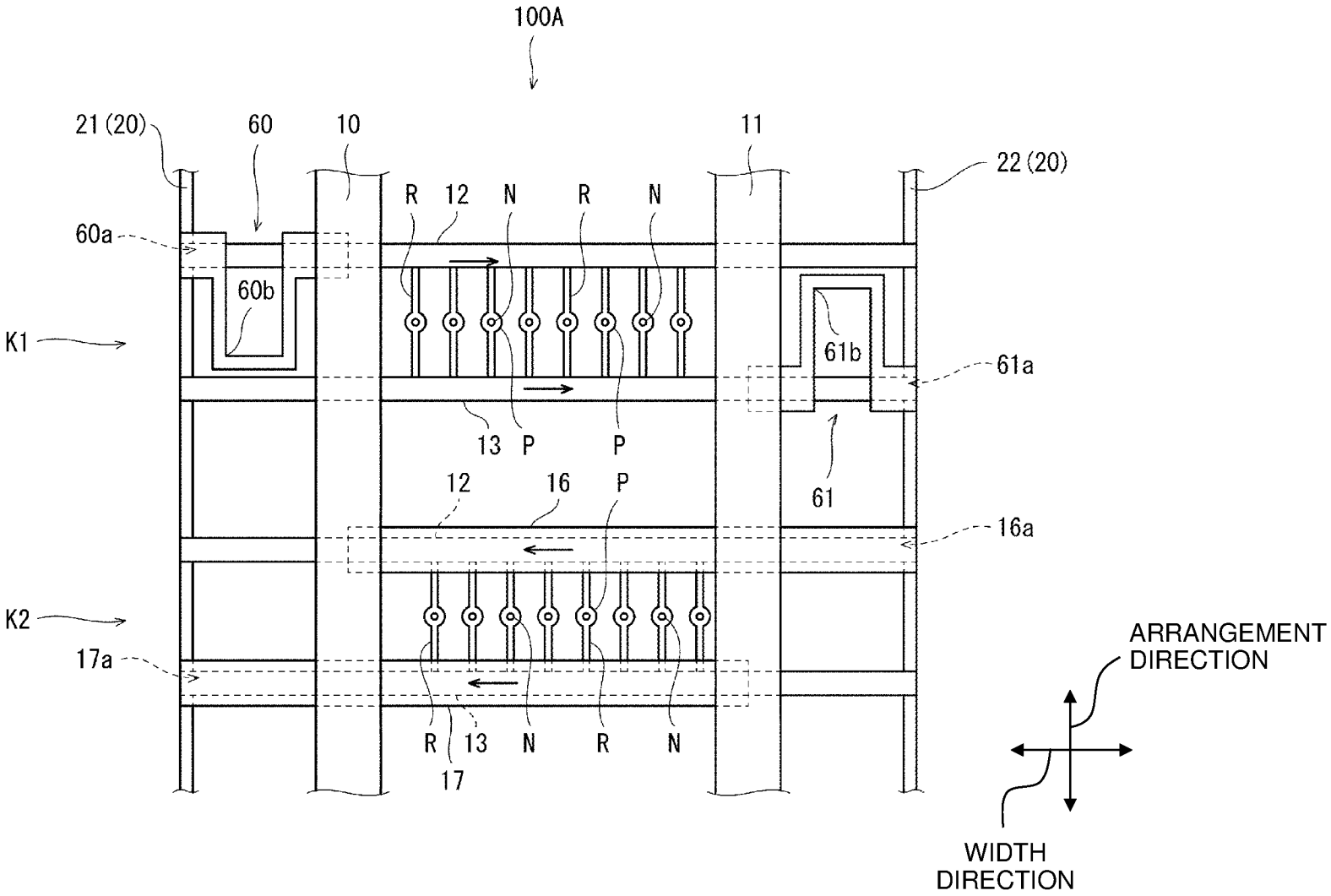
FIG. 7 is a plan view depicting a liquid discharging head according to a second embodiment of the present disclosure.

As depicted in FIG. 7, a first interposer channel 60 is a component for the supply-return combination K1. The first interposer channel 60 connects or links the supply manifold 12 in the supply-return combination K1 and the supply integration channel 10. An outlet port 60*a* of the first interposer channel 60 is arranged on the side of the left end with respect to a central part in the longitudinal direction of the supply manifold 12; the outlet port 60*a* is connected to the left end of the supply manifold 12. A length (length in the width direction) of the first interposer channel 60 is made to be shorter than the length of the second interposer channel 16. In such a configuration, the liquid from the supply integration channel 10 is allowed to flow into the supply manifold 12 via the first interposer channel 60.

In the second embodiment, the first interposer channel 60 has one piece or a plurality of pieces of a bent part 60*b*. Specifically, unlike the first interposer channel 14, in the first embodiment, which is formed to be a straight shape in the width direction, the first interposer channel 60 in the second embodiment includes the part 60*b* which is bent in the arrangement direction toward the return manifold 13 in the supply-return combination K1. With this, the channel length of the first interposer channel 60 can be made longer than the channel length of the first interposer channel 14. Note that in the first interposer channel 60, it is allowable to provide a curved part, instead of the above-described bent part 60*b*, or to provide the bent part 60*b* and the curved part in combination.

On the other hand, a returning short interposer channel 61 is a component for the supply-return combination K1. The returning short interposer channel 61 connects or links the one return manifold 13 in the supply-return combination K1 and the return integration channel 11. An inlet port 61*a* of the returning short interposer channel 61 is arranged on the side of the right end with respect to a central part in the longitudinal direction of the return manifold 13. The liquid from the return manifold 13 is allowed to flow into the return integrated channel 11 via the returning short interposer channel 61.

In the second embodiment, the returning short interposer channel 61 has one piece or a plurality of pieces of a bent part 61*b*. Specifically, unlike the returning short interposer channel 15, in the first embodiment, which is formed to be a straight shape in the width direction, the returning short interposer channel 61 in the second embodiment includes the part 61*b* which is bent in the arrangement direction toward the supply manifold 12 in the supply-return combination K1. With this, the channel length of the returning short interposer channel 61 can be made longer than the channel length of the returning short interposer channel 15. Note that in the returning short interposer channel 61, it is allowable to provide a curved part, instead of the above-described bent part 61*b*, or to provide the bent part 61*b* and the curved part in combination.

Also in the liquid discharging head 100A of the second embodiment, similarly to the liquid discharging head 100 of the first embodiment, it is possible to suppress any variation in the discharging property between the nozzle N arranged on the side of the one end in the width direction of each of the supply manifolds 12 and the nozzle N arranged on the side of the other end in the width direction of each of the supply manifolds 12.

Further, in the second embodiment, the channel length of the first interposer channel 60 can be made longer than the channel length of the first interposer channel 14 in the first embodiment, and the channel length of the returning short interposer channel 61 can be made longer than the channel length of the returning short interposer channel 15 in the first embodiment. Accordingly, it is possible to secure the channel resistance of each of the first interposer channel 60 and the returning short interposer channel 61,

Other Embodiments

The present invention is not limited to or restricted by the above-described embodiments, and a variety of kinds of change or modification can be made within a range not departing from the gist and spirit of the present invention, as exemplified, for example, as follows.

In the above-described embodiments, the channel width of the first interposer channel 14 is made to be greater than the channel width of the supply manifold 12, and the channel width of the second interposer channel 16 is made to be greater than the channel width of the supply manifold 12, as depicted in FIG. 2; however, there is no limitation thereto. It is allowable that the channel width of the first interposer channel 14 is made to be smaller than or same as the channel width of the supply manifold 12, and the channel width of the second interposer channel 16 is made to be smaller than or same as the channel width of the supply manifold 12.

Further, in the above-described embodiments, the outlet port 14*a* of the first interposer channel 14 is arranged on the side of the one end in the longitudinal direction of the one supply manifold 12, and the outlet port 16*a* of the second interposer channel 16 is arranged on the side of the other end in the longitudinal direction of the another supply manifold 12. In relation to this configuration, it is allowable to arrange the outlet port 14*a* of the first interposer channel 14*a* at least at a location closer to the one end than to the other end in the longitudinal direction of the one supply manifold 12 (one end-side of the center in the longitudinal direction of the one supply manifold 12), and to arrange the outlet port 16*a* of the second interposer channel 16*a* at least at a location closer to the other end than to the one end in the longitudinal direction of the another supply manifold 12 (other end-side of the center in the longitudinal direction of the one supply manifold 12).

Furthermore, in the above-described embodiments, the return manifold 13 is provided on each of the supply-return combinations K1 and K2, the return manifold 13 is not an indispensable or essential constituent element (component).

What is claimed is:

1. A liquid discharging head comprising:

a plurality of supply manifolds which is configured to receive a liquid to be discharged from a plurality of nozzles, each of the plurality of supply manifolds extending in a longitudinal direction of the plurality of supply manifolds, the plurality of supply manifolds being provided side by side with each other along an arrangement direction crossing the longitudinal direction of the plurality of supply manifolds;

a supply integration channel arranged on a first side in the longitudinal direction of the plurality of supply manifolds;

a first connecting channel connecting the supply integration channel and a first supply manifold of the plurality of supply manifolds; and a second connecting channel connecting the supply integration channel and a second supply manifold of the plurality of supply manifolds, the second supply manifold being different from the first supply manifold and being adjacent to the first supply manifold in the arrangement direction of the plurality of supply manifolds, wherein an outlet of the first connecting channel is arranged on the first side in the longitudinal direction of the plurality of supply manifolds; and an outlet of the second connecting channel is arranged on a second side, opposite to the first side, in the longitudinal direction of the plurality of supply manifolds.

2. The liquid discharging head according to claim 1, further comprising:

a plurality of return manifolds configured to receive the liquid not having been discharged from the plurality of nozzles; and a bypass channel which connects one of the plurality of supply manifolds and one of the plurality of return manifolds adjacent to the one of the plurality of supply manifolds directly to one another.

3. The liquid discharging head according to claim 2, wherein the bypass channel includes:

an upstream bypass channel communicating an upstream end of the one of the plurality of supply manifolds with an upstream end of the one of the plurality of return manifolds; and a downstream bypass channel communicating a downstream end of the one of the plurality of supply manifolds with a downstream end of the one of the plurality of return manifolds.

4. The liquid discharging head according to claim 1, wherein a flowing direction of the liquid in the first supply manifold and a flowing direction of the liquid in the second supply manifold are mutually opposite directions.

5. The liquid discharging head according to claim 1, wherein the first connecting channel is connected to an end of the first supply manifold, and the second connecting channel is connected to an end of the second supply manifold.

6. The liquid discharging head according to claim 1, wherein a channel resistance in the first connecting channel and a channel resistance in the second connecting channel are identical to each other.

7. The liquid discharging head according to claim 6, wherein a channel cross-sectional area of the first connecting channel is different from a channel cross-sectional area of the second connecting channel.

8. The liquid discharging head according to claim 1, wherein the first connecting channel includes a curved part or a bent part.

9. The liquid discharging head according to claim 1, wherein the plurality of nozzles is arranged in the longitudinal direction of the plurality of supply manifolds.

* * * * *